US005203428A

United States Patent [19]

Beeche

[11] Patent Number: 5,203,428

[45] Date of Patent: Apr. 20, 1993

[54] MODULAR SCAFFOLDING PLATFORM AND TRUSS FRAME COMPONENTS THEREFOR

[75] Inventor: Gregory L. Beeche, Rexford, N.Y.

[73] Assignee: Garox Corporation, Prior Lake, Minn.

[21] Appl. No.: 442,414

[22] Filed: Nov. 21, 1989

Related U.S. Application Data

[63] Continuation of Ser. No. 349,713, May 10, 1989, abandoned, which is a continuation of Ser. No. 48,108, May 7, 1987, abandoned.

[51] Int. Cl.[5] ..... E04G 5/00

[52] U.S. Cl. ..... 182/222; 182/179; 182/113

[58] Field of Search ..... 182/222, 130, 113, 129, 182/179

[56] References Cited

U.S. PATENT DOCUMENTS

| | | | |
|---|---|---|---|
| 2,851,311 | 9/1958 | Gibbs | 182/130 |
| 2,882,100 | 4/1959 | Bank | 182/129 |
| 3,752,262 | 8/1973 | Helms | 182/113 |

OTHER PUBLICATIONS

Space Grid Structure, by John Borrego, pp. 24, 99, 39, 40, 17, 19.

*Primary Examiner*—R. Machado

*Attorney, Agent, or Firm*—Heslin & Rothenberg

[57] ABSTRACT

A truss frame with three-dimensional bracing includes at least three top rails which are joined together so as to define a substantially planar surface. A plurality of bracing members are attached to the top rails and depend toward a bottom connection which have a predetermined location with respect to the top rails. The bottom connection location is chosen so that the bracing members form truss-like braces for the top rails. In one embodiment, the top rails, bracing members, and bottom connection form the shape of a pyramid. A plurality of these truss frames is utilized to form a modular platform. The platform also includes means for fastening the top rails of adjoining truss frames together so as to form a continuous top chord in a direction parallel to that spanned by the connected truss frames. The platform preferably further includes means for connecting together the bottom connections of the truss frames so as to form a bottom chord which also extends in a direction parallel to that spanned by the connected frames. The modular platform may also include filler panels connected between predetermined ones of the truss frames, as well as decking mounted on the truss frames so as to provide a substantially continuous supporting surface and railing members which may be attached to the truss frames so as to provide the platform with a guardrail around at least a portion of the perimeter thereof.

30 Claims, 5 Drawing Sheets x
z
y
62
64
66
36
72
44
52
18
22
20
38
28
60
70
68

16
36
40
62
68

MODULAR SCAFFOLDING PLATFORM AND TRUSS FRAME COMPONENTS THEREFOR

This application is a continuation of application Ser. No. 349,713 filed May 10, 1989, which is a continuation of Ser. No. 048,108, filed May 7, 1987, both now abandoned.

BACKGROUND OF THE INVENTION

This invention relates to scaffolding systems of the type used in building construction and maintenance. More particularly, it relates to a modular platform that is extremely adaptable and can be assembled in a variety of sizes and configurations, while at the same time having high structural integrity, span strength, and torsional rigidity.

A variety of scaffolding systems have been employed in the past to provide artisans with a suitable area from which to perform their tasks on various portions of buildings or other structures. Such scaffolding systems have been used in tasks ranging from applying siding to buildings under construction to washing the windows of a completed building.

In the past, when a scaffolding system was required for a particular task, the scaffolding would be constructed so that the task involved could be performed on one portion of the building at a time. The constructed scaffolding was typically not moveable from one portion of the building to another. Instead, the scaffolding system frequently required disassembly before being moved, and reassembly after being moved to another portion of the building. For such prior art scaffolding systems, a considerable amount of time and energy is required to dismantle and reassemble the scaffolding each time it is moved. Typically, a plurality of parts of various sizes and shapes must be individually connected and disconnected during assembly and disassembly, respectively, of the scaffold. Furthermore, the workers involved in constructing this type of scaffolding are often at a safety risk, because of the manner in which the work platforms are suspended between the vertical supports. Typically, vertical ladders are provided for holding the ends of the work platforms, and it is necessary for workers to scale these ladders in order to attach the work platforms to the ladders. Another problem which has been encountered in past scaffolding systems is the inability to individually change the levels of the various work platforms without dismantling a substantial portion of the scaffolding.

The scaffolding systems described in U.S. Pat. Nos. 4,234,055 and 4,253,548, issued to G. L. Beeche on Nov. 18, 1980 and Mar. 3, 1981, respectively, alleviate many of the problems associated with prior art scaffolding systems. U.S. Pat. No. 4,234,055 describes a mobile suspension scaffold which requires assembly and dismantling only once for each construction site, at the beginning of the job and at the end of the job, respectively. The scaffolding system disclosed includes a mobile roof vehicle which permits the scaffold to be moved along the sides of a building and around building corners without being disassembled. The scaffold containing the work platforms may be suspended from the roof vehicle and assembled by starting at the top and working downwardly, or it may be assembled by starting at the ground and working upwardly. The scaffold is suspended so that a plurality of work platforms can be disposed at preselected levels through utilization of the suspension system itself. A particularly useful suspended scaffold system is the folding scaffold described in U.S. Pat. No. 4,253,548. The scaffold described therein employs a plurality of work platforms in combination with a chain of foldably linked end support sections disposed in a mechanical relationship which permits the scaffold to be collapsed into a relatively small configuration for storage and transportation, and then unfolded into its erected state at the building site. The work platforms are slidably engaged in the end support sections, and may be raised or lowered independently of raising or lowering the end supports. The individual work platforms are selectively attached to the end support sections at desired levels as the end supports are unfolded, and may also be raised or lowered to different levels while the scaffolding system remains erected.

As the number and variety of scaffolding systems needed for modern-day building construction and maintenance has grown, a problem that has arisen is the requirement imposed by such construction and maintenance of individually tailoring the scaffold to the particular task at hand. Designing and constructing uniquely customized scaffolding systems for every building construction or maintenance project is both time-consuming and relatively expensive. What is needed is a scaffolding system that is adaptable to meet the requirements of a wide variety of applications. The system must also have sufficient rigidity to provide a safe work area for artisans who use the scaffolding and for their materials.

Co-pending U.S. application Ser. No. 861,133, filed May 8, 1986 in the name of G. L. Beeche and assigned to the present assignee, discloses a modular scaffolding system which is readily adaptable for use in a wide variety of applications. The present invention provides a scaffolding platform which may be used either in conjunction with the scaffolding system disclosed in application Ser. No. 861,133, or independently thereof. The modular platform of the present invention provides a work platform that may be varied in size and configuration in order to meet the requirements of a variety of situations.

The modular platform of the present invention utilizes a truss frame component which is braced in three dimensions so as to achieve high resistance to structural deformation caused by externally applied loads. While three-dimensional bracing itself is not new, the principles of that concept have not previously been applied to the scaffolding arts in order to provide modular components for a truss frame platform. The present inventor has found that truss frames with such bracing can be utilized to form a modular platform that has such high structural integrity that the platform can be used as a truss beam for spanning long distances.

It is an object of the present invention to provide a scaffolding platform which is readily adaptable for use in a wide variety of applications.

It is a further object of the present invention to provide a modular platform in which a limited number of interchangeable components may be assembled in a wide variety of sizes and configurations.

It is another object of the present invention to provide truss frame components which, when assembled to form the modular platform, impart to the platform both high span strength and high torsional rigidity.

It is also an object of the present invention to provide truss frame components which are easily stored and transported.

SUMMARY OF THE INVENTION

In accordance with one aspect of the present invention, a truss frame with three-dimensional bracing comprises at least three top rails which are joined together so as to define a substantially planar surface. A plurality of bracing members are attached to and depend from the top rails. The bracing members are disposed so that all of them are connected together at one end thereof to form a bottom connection which has a predetermined location with respect to the top rails. The location of the bottom connection is chosen so that the bracing members form truss-like braces for the top rails. The truss frame may further comprise means by which the top rails of adjoining truss frames may be connected together so that the top rails of the connected truss frames form a continuous top chord, and means by which the bottom connections of adjoining truss frames may be connected to each other so as to form a bottom chord in the direction spanned by the connected truss frames. Each truss frame may also include decking mounted to the top rails so as to form a supporting surface thereon, and one or more rail members connected to the truss frame so as to form a guardrail around at least a portion of the perimeter thereof. The inventive truss frame preferably further comprises means by which external apparatus, such as suspension cables, support columns, or scaffolding accessories, may be attached directly to the truss frame.

In accordance with another aspect of the present invention, a modular platform comprises a plurality of truss frames of the type described above. The platform includes means for fastening the top rails of adjoining truss frames together so as to form a continuous top chord in a direction parallel to that spanned by the connected truss frames. It also preferably includes means for connecting the bottom connections of the truss frames together so as to form a bottom chord which extends in a direction parallel to that spanned by the connected frames. The modular platform may further comprise filler panels located between predetermined ones of the truss frames. In one embodiment, opposite ends of each filler panel are connected to the respective adjoining truss frames by fastening the respective end of the filler panel to the adjacent top rail of the respective adjoining truss frame. The modular platform of the present invention may also include decking mounted on the truss frames and filler panels so as to provide the platform with a substantially continuous supporting surface. A plurality of railing members may also be attached to the truss frames so as to provide the platform with a guardrail around the perimeter thereof.

BRIEF DESCRIPTION OF THE DRAWINGS

The subject matter which is regarded as the invention is particularly pointed out and distinctly claimed in the concluding portion of the specification. The invention itself, however, both as to its organization and its method of practice, together with further objects and advantages thereof, may best be understood by reference to the following description taken in conjunction with the accompanying drawings, in which:

DETAILED DESCRIPTION OF THE PREFERRED EMBODIMENTS

Figure 1:
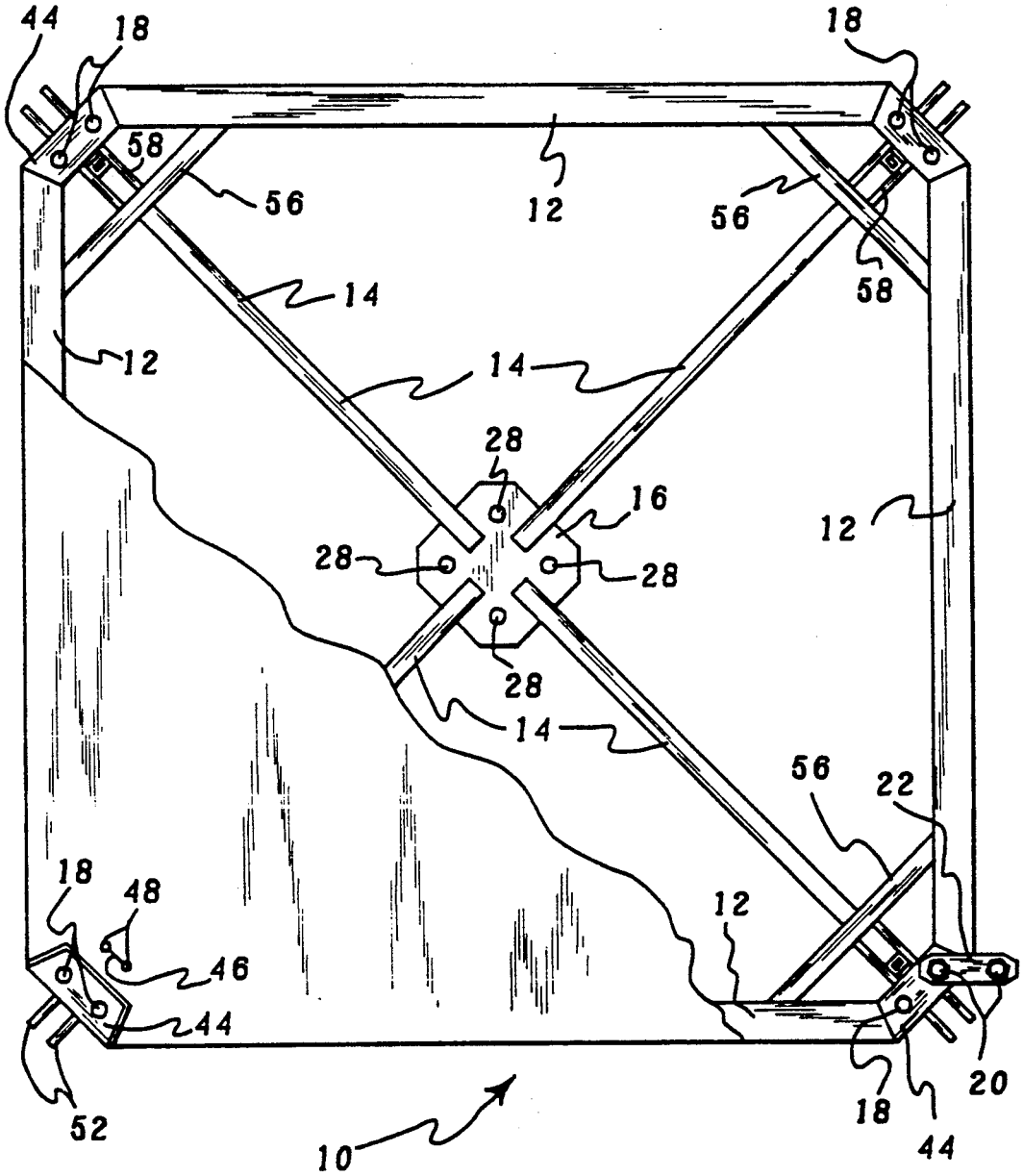
FIG. 1 is a plan view schematically illustrating one embodiment of a truss frame in accordance with the present invention.

FIG. 1 schematically illustrates one embodiment of a truss frame which is especially useful as a component for a modular platform. In order to illustrate the underlying structure of the truss frame, most of decking 42 has been removed in the view of FIG. 1. The truss frame of the present invention comprises at least three top rails which are joined together so as to define a substantially planar surface. In the preferred embodiment shown in FIG. 1, truss frame 10 comprises four top rails 12, with rails 12 being joined end to end so that rails 12 define a closed loop. In the particular embodiment shown rails 12 are disposed so as to form the shape of a square. Truss frame 10 also comprises a plurality of bracing members 14 which are attached to top rails 12 and which depend therefrom. Members 14 are disposed so that all of members 14 are connected together to form bottom connection 16. Bottom connection 16 has a predetermined location with respect to rails 12, with the predetermined location being chosen so that bracing members 14 form truss-like braces for top rails 12. In the embodiment shown, each bracing member 14 is disposed so that one end thereof is attached to one of top rails 12, and the other end thereof is attached to the remaining bracing members 14 at bottom connection 16. Preferably, bracing members 14 are further disposed so that each top rail 12 is attached to at least one of bracing members 14. In the embodiment of FIG. 1, four bracing members 14 are employed, with each member 14 being attached to top rails 12 at the locations where rails 12 are joined to each other, that is, at the locations of the corners of the square formed by rails 12. In order to provide truss frame 10 with optimum modularity and uniform strength, bracing members 14 are preferably further configured with respect to top rails 12 so as to be symmetrically disposed about a plane which is taken through the center of bottom connection 16, which plane is perpendicular to the plane containing top rails 12. In one such configuration, top rails 12, bracing members 14, and bottom connection 16 form the shape of an inverted pyramid, in the manner illustrated by truss frame 10. The pyramidal shape of truss frame 10 is better illustrated in FIG. 2, which is an oblique side elevation view of the truss frame shown in FIG. 1.

Truss frame 10 may also comprise means by which top rails 12 of one truss frame may be connected to the corresponding top rails of adjoining truss frames, when two or more truss frames are connected together to form a platform. The means for connecting together adjacent top rails is disposed so that the top rails of the connected truss frames form a continuous top chord in a direction parallel to the direction along which the truss frames are connected, that is, the direction spanned by the connected frames. In the embodiment shown in FIGS. 1 and 2, top rails 12 of adjoining truss frames 10 are connected to each other by means of apertures 18 which extend generally in a direction which is perpendicular to a plane containing top rails 12. To connect adjacent top rails 12, fastening bolts 20 are inserted through top and bottom link portions 22 and 24, respectively, and through apertures 18, in the manner illustrated in FIGS. 1 and 2. In an alternative embodiment which is not shown, adjacent top rails 12 are connected together by inserting fastening bolts through apertures in adjacent rails 12, which apertures are aligned with each other and which extend in a direction which is generally parallel to a plane containing top rails 12.

Truss frame 10 also may include means by which bottom connection 16 of one truss frame 10 may be connected to the bottom connections of adjoining truss frames when two or more truss frames are connected together to form a platform. The means employed for connecting together the bottom connections of adjoining truss frames is disposed so that a bottom chord is formed which extends in a direction parallel to the direction spanned by the connected truss frames. In the embodiment illustrated by FIGS. 1 and 2, the bottom connections of adjoining truss frames are connected together by means of apertures 28 defined through bottom connection plates 30 and 32. Apertures 28 extend generally in the same direction as apertures 18. Plate 32 is separated from plate 30 for a predetermined distance by spacer member 34. One end of spacer 34 is attached to plate 30 and the other end thereof is attached to plate 32, so that spacer member 34 also serves to attach plates 30 and 32 together. As is better illustrated in FIGS. 3 and 4, in order to join together bottom connections 16 of adjoining truss frames, linking member 36 is fastened at its opposite ends to the respective bottom connections by bolts 38 which pass through apertures 28.

When truss frame 10 is utilized to provide a support surface, truss frame 10 further comprises decking 42 mounted to top rails 12 so as to form a substantially continuous surface thereon. For the embodiment illustrated in FIG. 1, corner members 44 of truss frame 10 protrude slightly above the level of rails 12, but not above the level of decking 42, so that the supporting surface provided by decking 42 is substantially flat. Furthermore, decking 42 may be cut to fit closely around each corner member 44. With corner members 44 and decking 42 configured in this manner, decking 42 is constrained from movement in a plane parallel to the plane containing top rails 12. Decking 42 may also be restrained from upward movement, in a direction which is perpendicular to a plane containing top rails 12, by any suitable means, such as, for example, gluing or screwing decking 42 to top rails 12. One especially convenient means for restraining decking 42 from movement in an upward direction is to fasten decking 42 to bracing members 14 by tie wires 46 which are threaded through apertures 48 in decking 42 and fastened around bracing members 14. Decking 42 may be chosen from a wide variety of materials which meet the requirements of a particular application. One convenient material for decking 42 is plywood, the thickness and grade quality of which can be chosen to accomodate the strength requirements and environmental conditions of the application involved.

For storage and shipping of truss frame 10, decking 42 is usually removed so that a plurality of truss frames 10 can be stacked in a nested configuration. Doing so minimizes the space required for storing and shipping the components required to assemble a modular platform. Decking 42 may be installed either before or after the truss frames are assembled into a platform.

Figure 7:
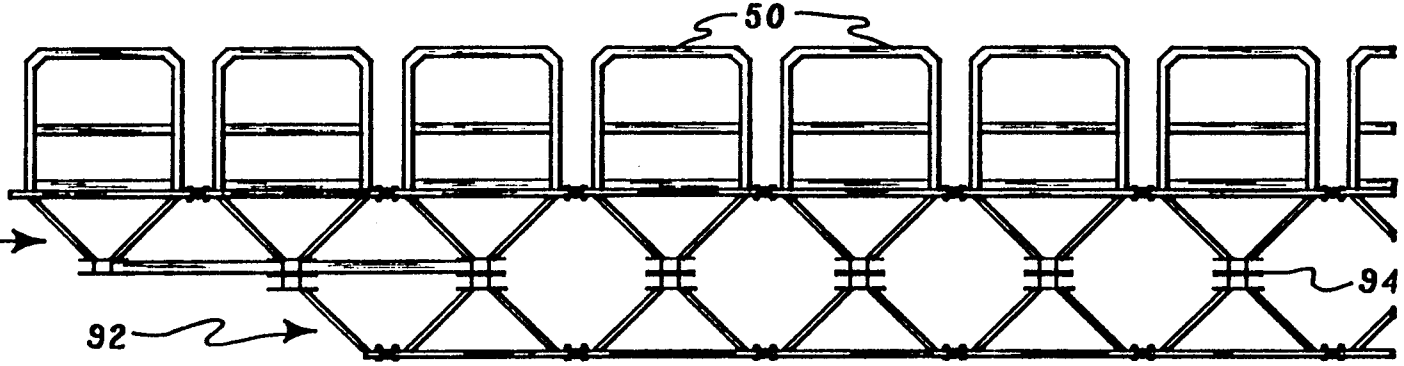
FIG. 7 is a side elevation view of a fourth embodiment of a modular scaffolding platform constructed in accordance with the present invention.

As is illustrated in FIG. 7, truss frame 10 may further comprise one or more rail members 50 connected to truss frame 10 so as to form a guardrail along predetermined ones of top rails 12. Rail members 50 provide safety for artisans working on the platform. The guardrail may also be employed to restrain materials and equipment from falling off the edge of the platform. Truss frame 10 may also comprise means by which external apparatus may be attached directly to at least one of top rails 12 of truss frame 10. In the embodiment illustrated in FIGS. 1 and 2, this function is provided by accessory tabs 52 having tab openings 54 defined therein. External apparatus may be attached to tabs 52 by means of a bolt or fastening pin inserted through tab openings 54. Tabs 52 and associated tab openings 54 are located at each corner of the square formed by top rails 12, thereby providing four separate attachment points for each truss frame 10. With direct attachment to the truss frame provided in this manner, truss frame 10 can be suspended from above by a suspension cable attached to at least one of accessory tabs 52, or it can be supported from below by a support column similarly attached to truss frame 10. Furthermore, several of accessory tabs 52 may be employed for supporting scaffolding accessories such as a cantilevered hoist beam or various scaffolding outriggers.

For optimum strength and rigidity, truss frame 10 may further comprise four corner braces 56 disposed so as to be located substantially coplanar with respect to top rails 12. Each corner brace 56 is located at one of the corners of the square formed by top rails 12. Each corner brace 56 is attached to the two top rails 12 which are joined by the respective corner of the square so that the two top rails 12 and corner brace 56 form a figure for which the base is longer than the top. For the configuration illustrated in FIG. 1, side rails 12 and corner brace 56, along with corner member 44, define the shape of a trapezoid. By arranging top rails 12 and corner brace 56 in this manner, the unbraced length of top rail 12 is shortened, and thereby strengthened. The bending point for top rails 12 is also moved from the corner back to the rails themselves. Also, a structure that has the shape of a triangle or trapezoid provides a stiffer structure with less weight. To further strengthen the bracing effect provided by corner brace 56, truss frame 10 may include brace channel 58 disposed between corner member 44 and corner brace 56. Bracing channel 58 is attached at its opposite ends to the respective adjacent ends of corner member 44 and corner brace 56. Truss frame 10 is provided with even more rigidity if bracing member 14 is also attached to corner brace 56. Doing so shortens the unbraced length of member 14, as well as providing yet another triange-type stiffener at each corner of truss frame 10. Channel 58 also serves as a convenient surface to which bracing member 14 may be welded, with channel 58 providing a relatively large surface area for such welding.

For most applications, it is preferable to form truss frame 10 from a high strength material such as metal.

For applications such as scaffolding, where it is desirable to use hollow members in order to save weight and cost, the various portions of truss frame 10 conveniently comprise tubular steel, and the attachments between the various portions of truss frame 10, such as, for example, rails 12, corner members 44, corner braces 56, bracing members 14, and bottom connection 16, may be welded.

Figure 3:
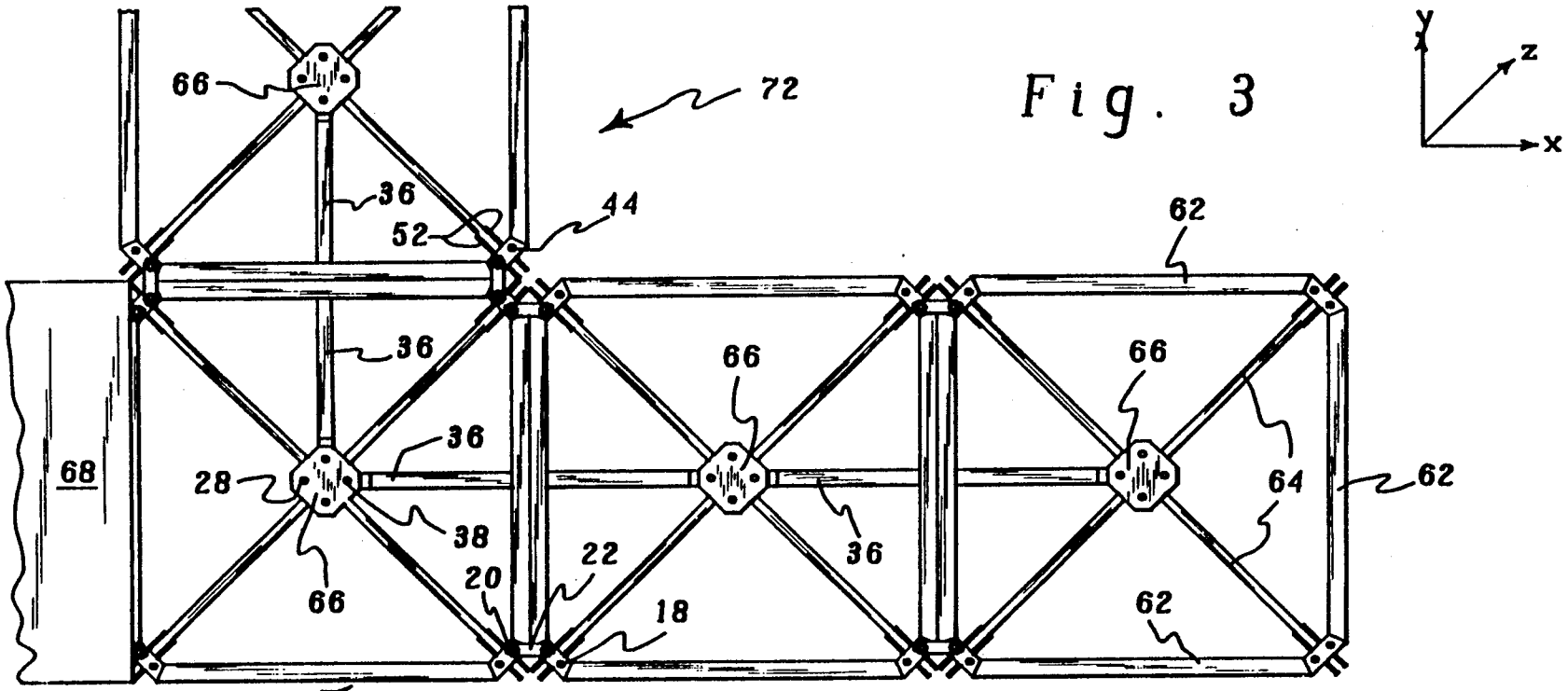
FIG. 3 is a plan view schematically illustrating a portion of a first embodiment of a scaffolding platform assembled in accordance with the modular concept of the present invention.
Figure 4:
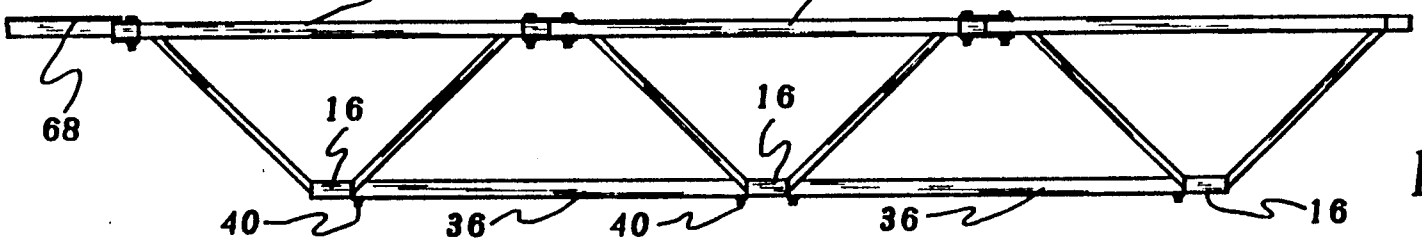
FIG. 4 is a side elevation view of the modular platform shown in FIG. 3.
Figure 5:
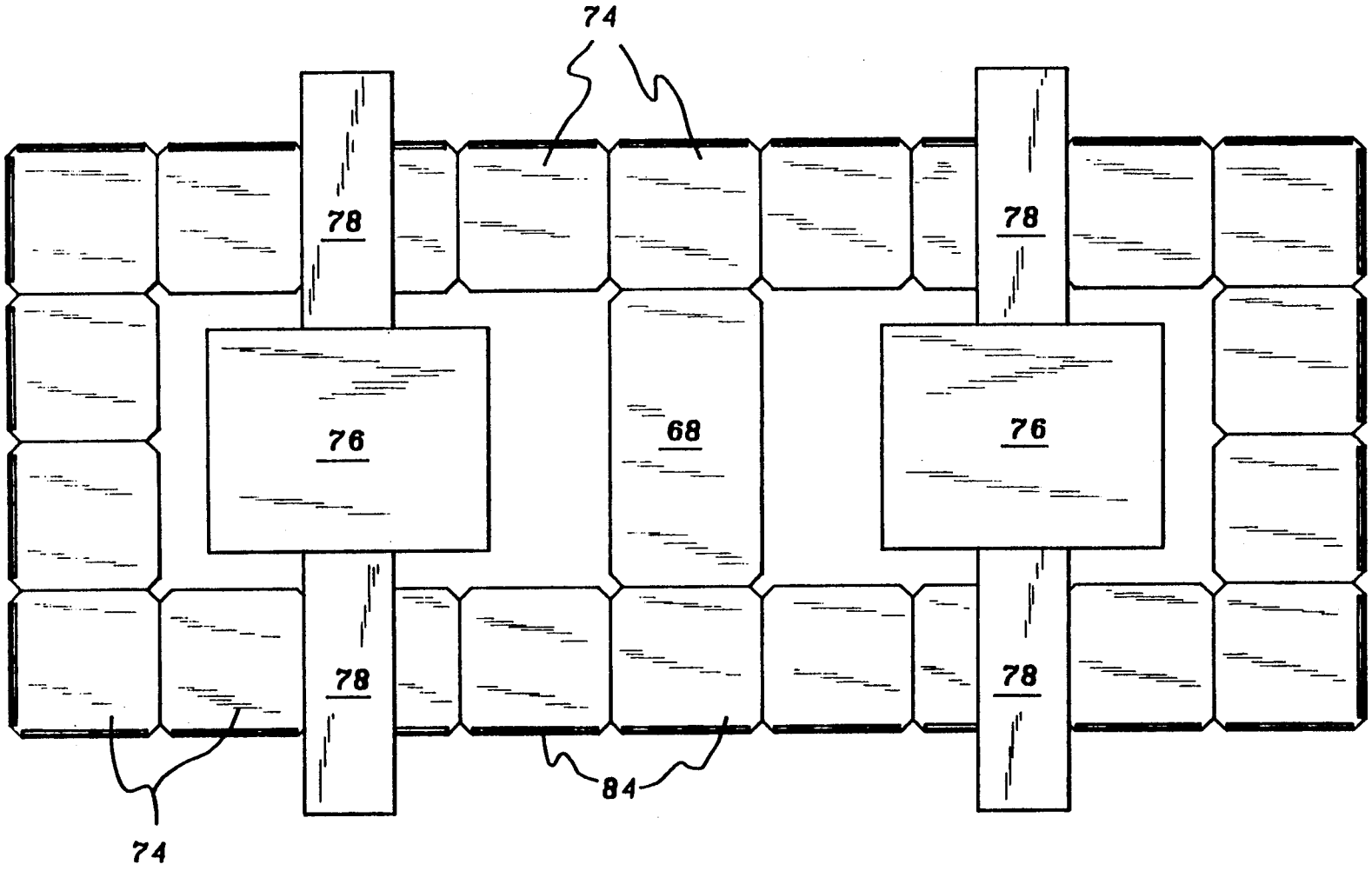
FIG. 5 is a plan view schematically illustrating a second embodiment of a scaffolding platform assembled in accordance with the modular configuration of the present invention.
Figure 6:
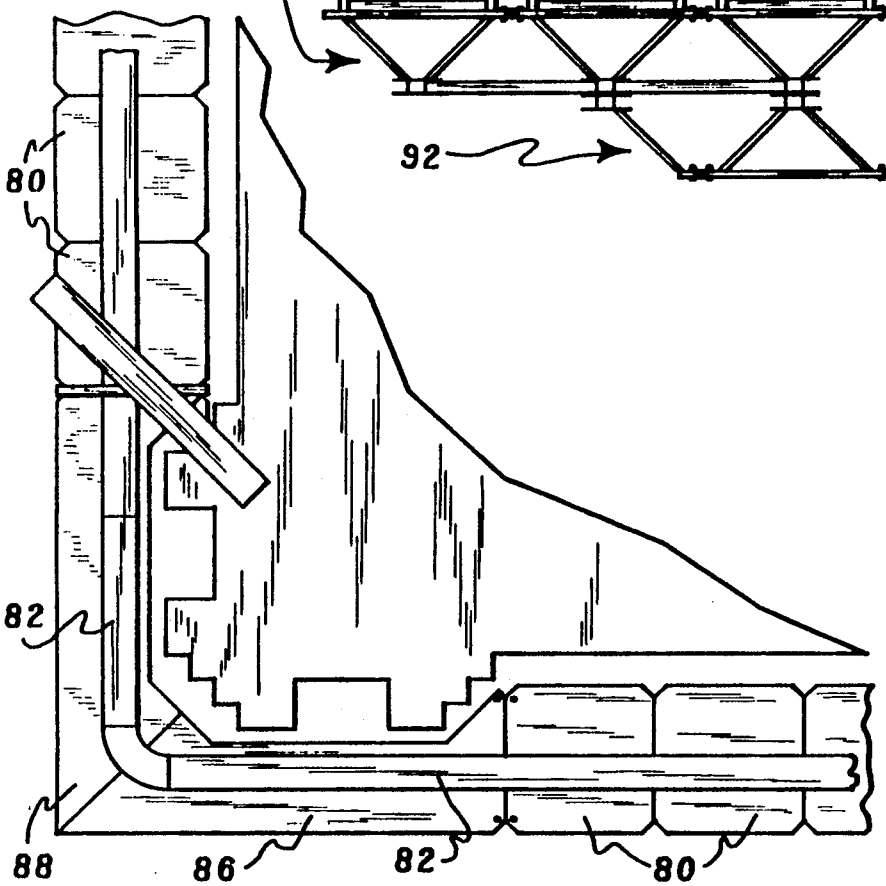
FIG. 6 is a plan view schematically illustrating a third embodiment of a modular platform in accordance with the present invention.

The truss frame of the present invention is especially useful as a component in a modular scaffolding platform. However, it should be understood that the modular platform provided by the instant invention is not limited to scaffolding systems, but rather may also be utilized in other applications where a structure having high span strength and torsional rigidity is desirable. FIGS. 3 and 4 schematically illustrate one embodiment of a structural platform that can be constructed in accordance with the modular concept of the present invention. Other platform arrangements that may be assembled using the same modular concept are illustrated in FIGS. 5–7. All of the platform configurations shown may be quickly and easily assembled using a few basic components. Because of the flexibility with which the platform components of the present invention may be assembled, most applications can be accommodated using very few, if any, customized components. The modular platform components can be assembled either partially or fully at the job site, and the decking which forms the support surface may be installed either before or after assembly of the components to form the desired platform. The platform components themselves may be made having dimensions and weight which facilitates ease of handling of the components. Components which are even small enough to fit through standard building entry ways can be assembled into platforms which are useful as interior scaffolding.

As is schematically illustrated by FIG. 3, a modular platform in accordance with the present invention comprises a plurality of truss frames 60. Each such truss frame includes at least three top rails which are joined together so as to define a substantially planar surface, and further includes a plurality of bracing members attached to and depending from the top rails. In the embodiment shown in FIG. 3, four top rails 62 and four bracing members 64 are utilized for each truss frame 60. Bracing members 64 are disposed so that all of members 64 are connected together to form bottom connection 66. Bottom connection 66 has a predetermined location with respect to top rails 62, which location is chosen so that bracing members 64 form truss-like braces for top rails 62. Top rails 62, bracing members 64 and bottom connection 66 are further disposed so as to form the shape of an inverted pyramid. Thus, truss frame 62 is very similar in structure to truss frame 10 shown in FIG. 1, the major difference between the two being that truss frame 10 includes corner braces 56 whereas truss frame 60 does not. The modular platform of FIG. 3 further comprises means for connecting together top rails 62 of adjoining truss frames 60 so that top rails 62 form a continuous top chord in a direction parallel to that spanned by the connected truss frames 60. For example, connecting together top rails 62 of adjoining truss frames 60 and 70 in FIG. 3 provides the platform with a top chord between frames 60 and 70 in a direction which is designated in FIG. 3 as the x-axis. Similarly, connecting together the top rails of truss frames 70 and 72 produces a top chord between frames 70 and 72 which extends in a direction which is designated in FIG. 3 as being the y-axis.

Figure 2:
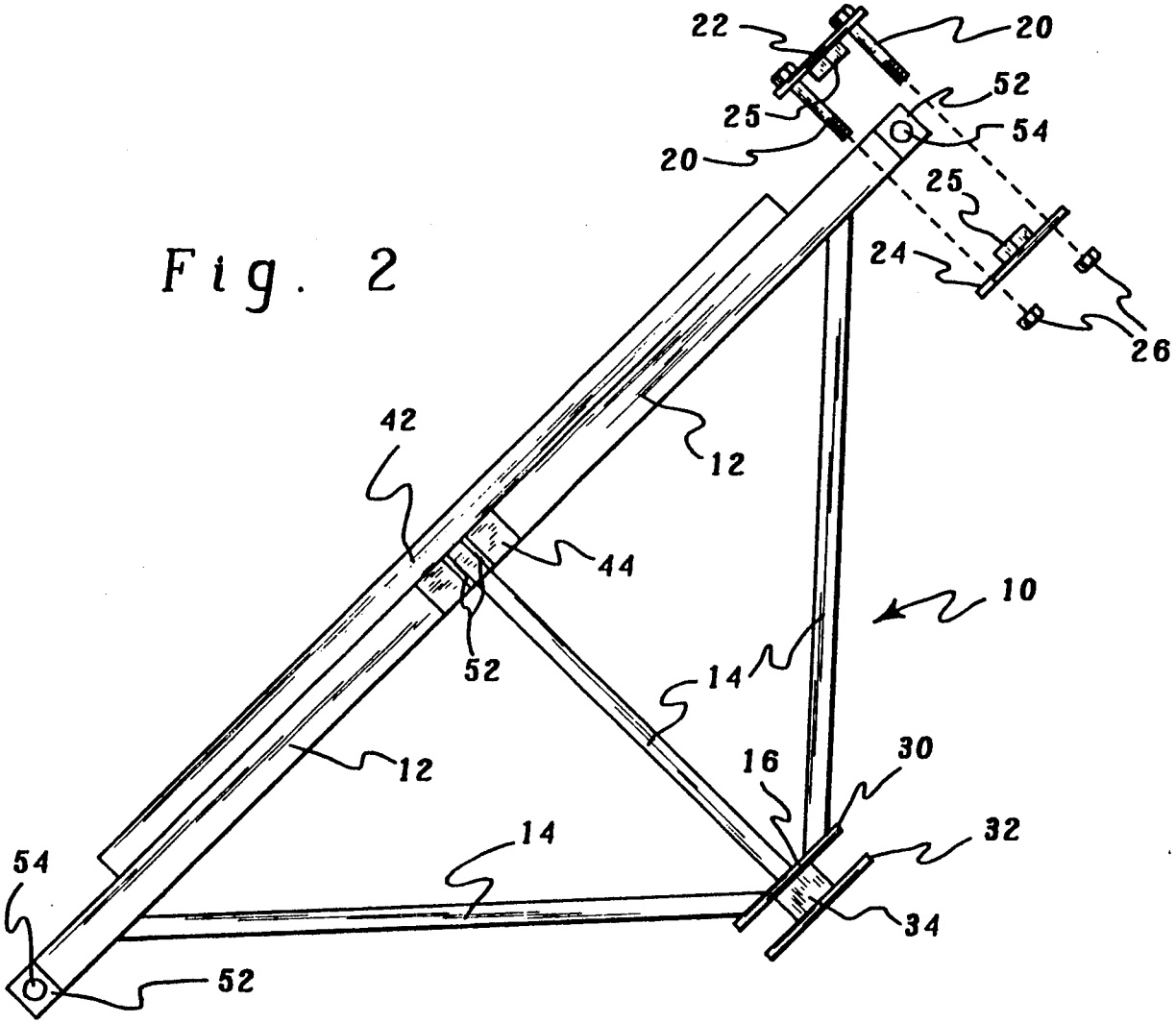
FIG. 2 is an oblique view in side elevation of the truss frame shown in FIG. 1.

In one embodiment, the means used for connecting top rails 62 to each other comprises the type of fastening link illustrated in FIG. 2. As shown therein, a top link portion 22 and bottom link portion 24 are fastened to the top and bottom surfaces, respectively, of the adjoining top rails 62. Link portions 22 and 24 are fastened together by bolts 20 inserted through appertures 18 in top rails 62. Bolts 20 are also inserted through correspondingly aligned apertures in link portions 22 and 24, and retaining nuts 26 are threadably engaged to bolts 20 with sufficient force to hold link portions 22 and 24 in position. For the truss frame embodiments illustrated in FIGS. 1 and 3, link portions 22 and 24 preferably include restraining tabs 25. Restraining tabs 25 are formed in the shape of a "V" or wedge, with the angle of the restraining tab being chosen to match the angle which is formed by adjacent top rails 62 in the vicinity of where rails 62 are joined together. With restraining tabs 25 so configured, tabs 25 serve to restrain adjacent rails 62 in position with respect to each other.

The platform of FIG. 3 preferably further comprises means for connecting together bottom connections 66 of predetermined ones of the truss frame components, so as to form a bottom chord which extends in the same direction as the direction in which the connected truss frames extend. For example, when bottom connections 66 of truss frames 60 and 70 are connected together in the manner shown in FIG. 3, a bottom chord is formed in the direction designated in FIG. 3 as the x-axis. When bottom connections 66 of truss frames 70 and 72 are connected together in the manner shown in FIG. 3, a bottom chord is formed in the direction designated as the y-axis. In the embodiment of FIG. 3, bottom connections 66 of adjoining truss frames are connected together by linking members 36. Opposite ends of each linking member 36 are attached to the respective bottom connections by means of a bolt or other fastener inserted through apertures 28 in bottom connections 66.

With the top rails and bottom connections of the truss frame components being connected together in the manner illustrated in FIG. 3, the truss frame components can be utilized to form a truss beam in either of two perpendicular directions. Furthermore, bracing members 64 act as diagonal braces between the resulting top and bottom chords. Thus, the modular platform is braced in three dimensions in such a manner that it distributes and directs loading forces so that the forces travel along the truss frame components by the same paths as loading forces travel in other three dimensional braced structures. Such three dimensional trusses provide high structural integrity and torsional rigidity.

The structural integrity and torsional rigidity of the modular platform of the present invention is such that the platform can be expanded in either lateral direction. Thus, modular platforms may be assembled in virtually any size or shape. For example, as is illustrated in FIG. 5, single lines of truss frames may be assembled and attached to each other at a perpendicular angle in order to completely enclose the structure for which access is to be provided. As shown in FIG. 5, the platform may comprise a perimeter line of truss frames 74, with the adjoining top rails and bottom connections of truss frames 74 being connected together to form top and bottom chords, respectively. In many applications no interior truss frames are necessary to maintain the structural integrity of the platform. Thus, building columns 76 may be entirely enclosed by the modular platform. Furthermore, the platform may be suspended from building girders 78 at a variety of locations on the platform. For the same reasons, the truss frame components may be assembled in such a manner as to follow the contours of a building structure, in the manner illustrated by FIG. 6. Because the lines of truss frame components can be assembled at a perpendicular angle with respect to each other without affecting the stability or integrity of the platform, such a platform is stable even when suspended from suspension rail 82 by single cables located at various points along the platform. Furthermore disposing, the two lines of truss frames at a perpendicular angle with respect to each other serves to stabilize each of them against rotation.

Since the truss frame components of the inventive modular platform have structural integrity in all three directions when the truss frames are assembled as a braced three-dimensional structure, the platform can be suspended from above or it can be supported from below. In either case, the support points can be at the end of the span so as to form a beam configuration, or at various points along the length of the span so as to form a cantilevered configuration. To capitalize on this flexibility, the platform of the present invention preferably further comprises means for attaching external apparatus directly to at least one of the truss frame component top rails. One embodiment of an external apparatus attaching means is illustrated in FIG. 3. The instant inventor has determined that optimal flexibility in attaching external apparatus to the truss frame components is achieved by employing corner members 44 to join the ends of top rails 62 together, so that an access space is provided at the intersection point of any number of connected truss frame components, in the manner illustrated in FIG. 3. The access space and attachment points provided by corner members 44 and accessory tabs 52, respectively, by each truss frame component results in there being at least one such attachment point at each corner of each truss frame, and as many as four of such attachment points at a location where four truss frames are joined together. These multiple accessory attachment points allow for multiple suspension or support attachments when such multiple attachments are desirable to either accommodate excessive loading on the platform or for any other reason. Furthermore, accessory tabs 52 are capable of accepting eccentric loads, so that pairs of angled, opposing suspension cables may be utilized to stabilize the platform laterally.

Although not illustrated in FIG. 3, in most applications, the modular platform embodiment shown therein further includes decking mounted to top rails 62 so as to form a substantially continuous support surface thereon. For most scaffolding applications plywood of sufficient thickness and weathering qualities can be employed. Such a decking material is relatively inexpensive and can be quickly and easily replaced as necessary due to weathering, wear or damage. In most applications, it is also preferable for the modular platform to include one or more rail members connected to the truss frames so as to form a guardrail located along predetermined ones of the truss frame top rails, in the manner illustrated in FIGS. 5 and 7 by rail members 84 and 50, respectively. For the truss frame embodiment illustrated in FIG. 1, the rail members are conveniently mounted to the truss frame by means of apertures 18 in corner members 44. Whenever there is no adjoining truss frame located along any one of top rails 12, the corresponding apertures 18 are not in use and are available for fastening a rail member to that top rail. In one preferred embodiment, the rail members comprise U-shaped, unitary structures of the type shown in FIG. 7.

Because most of the modular platforms of the present invention can be made up of lines of truss frames with no adverse impact on the structural integrity of the platform, filler panels, of the type illustrated in FIGS. 3 and 5 as filler panels 68 , may be used to maintain a smooth and continuous support surface for the platform. Filler panels 68 are disposed between and connected to predetermined ones of the truss frame components of the platform. Preferably each said filler panel is connected to the top rails of the respective adjoining truss frames. Since the filler panels are not a part of the structural make up of the platform, and do not act as load transferring chords, the filler panels may be formed in virtually any size and shape. In order to maintain the modularity of the platform components, it is preferable that the filler panels have the same shape as the truss frame components and be in sizes which are multiples of the size of the truss frame components. However, if necessary, other sizes and shapes may be employed, such as filler panels 86 and 88 illustrated in FIG. 6. Using a combination of filler panels and truss frame components provides a lighter and less expensive platform than one made up entirely of truss frames. Thus, utilizing filler panels in a platform configuration optimizes the efficiency of the platform.

For unusually high loads on the platform or long span lengths, a stronger platform can be assembled by using the truss frame components of the present invention in the manner illustrated in FIG. 7. As shown therein, the second line of truss frames 92 may be attached vertically at connections 94 to a first line of truss frames 90 in order to effectively double the distance between the top and bottom chords of the truss beam. Because doubling the distance between the top and bottom chords of a beam doubles the beam's loading capacity, the platform configuration shown in FIG. 7 has four times the strength of a similar platform which utilizes only a single line of truss frames. As also illustrated in FIG. 7, single and double lines of truss frames can be combined in order to accomodate varying loads on the platform. By adding strength to the platform where it is needed and minimizing the weight of the platform in areas where less strength is needed, a high efficiency modular platform can be assembled. Also, although not illustrated in the Figures, the means employed for connecting together the bottom connections of the truss frames may be further disposed so as to provide the resulting platform with a built-in camber. Either negative or positive camber can be introduced to the platform. However, providing the platform with a positive camber has the effect of compensating for the loading force produced by both the weight of the platform and external loads apply thereto.

The foregoing describes a modular platform in which a limited number of interchangeable components may be readily assembled into a wide variety of configurations. The flexibility afforded by the platform of the present invention facilitates assembly of a platform of virtually any size or shape, with very few or no customized components being required. The present invention also provides truss frames which may be assembled into a platform having both high span strength and high torsional rigidity. At the same time, the truss frame components of the present invention may be made of a size and configuration which is easily stored and transported.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A truss frame for a modular scaffolding platform, comprising:

at least three tubular top rails, said rails being joined together so as to define a substantially planar surface;

means by which at least one top rail of the truss frame may be readily detachably connected to at least one top rail of an adjoining truss frame when two or more of said truss frames are connected together to form a platform, said rail-connecting means being disposed so that, when said truss frames are connected together in said platform, the top rails of said connected truss frames form a continuous top cord in a direction parallel to that spanned by said connected truss frames, and so that said connected truss frames exhibit high torsional rigidity;

a plurality of bracing members attached to and depending from said top rails, said members being disposed so that all of said members are connected together to form a bottom connection which has a predetermined location with respect to said top rails, said predetermined location being chosen so that said bracing members form truss-like braces for said top rails; and means by which the bottom connection of said truss frame may be connected to the bottom connection of an adjoining one of said truss frames when two or more of said truss frames are connected together to form a platform, said bottom connection including means for readily detachably receiving bottom connection joining means such that said joining means may be connected to and detached from said bottom connection without requiring disconnection of the top rails of adjoining truss frames, said joining means being disposed so that, when said bottom connections are joined together, a bottom chord is formed which extends in a direction parallel to that spanned by said connected truss frames.

2. The truss frame of claim 1 further comprising readily removable decking mounted to said top rails so as to form a substantially continuous support surface thereon.

3. The truss frame of claim 1 further comprising one or more rail members detachably connected to said truss frame so as to form a guardrail located along predetermined ones of said top rails.

4. The truss frame of claim 1 further comprising means by which external apparatus may be readily detachably connected directly to at least one of said top rails of said truss frame.

5. The truss frame of claim 1 wherein said top rails and said bracing members are formed from a material comprising metal.

6. The truss frame of claim 1 wherein said top rails are joined end to end, so that said rails define a closed loop.

7. The truss frame of claim 6 wherein four of said top rails are disposed so as to form the shape of a square.

8. The truss frame of claim 7 further comprising means for readily detachably connecting external apparatus to said top rails, said means being disposed so that said external apparatus may be connected to said truss frame at the location of any of the corners of said square.

9. The truss frame of claim 1 wherein said bracing members are further disposed so that each of said top rails is attached to at least one of said bracing members.

10. The truss frame of claim 9 wherein said bracing members are further configured with respect to said top rails so as to be symmetrically disposed about a plane which is taken through the center of said bottom connection, which plane is perpendicular to the plane containing said top rails.

11. The truss frame of claim 7 wherein said bracing members comprise four of said members disposed so that said bracing members are attached to said top rails at the locations of the corners of said square.

12. The truss frame of claim 11 wherein said top rails, said bracing members, and said bottom connection form the shape of an inverted pyramid.

13. The truss frame of claim 7 further comprising four corner braces disposed so as to be substantially coplanar with respect to said top rails, each of said corner braces being located at one of the corners of said square and being attached to the two top rails which are joined at said corner so that said two top rails and said corner brace form a geometric figure for which the base is longer than the top.

14. The truss frame of claim 1 wherein said top rails have apertures defined therein which extend substantially in a direction which is perpendicular to said plane which contains said top rails, said apertures being further disposed so that fastening pins may be inserted therethrough and also through connecting links employed to connect together said top rails of said adjoining truss frames.

15. The truss frame of claim 1 wherein a pair of parallel, spaced-apart bottom connection plates are attached to said bottom connection of said truss frame, said bottom connection plates being disposed so as to be in planes which are substantially parallel to the plane which contains said top rails, said plates having apertures defined therein which extend substantially in a perpendicular direction to the plane containing said plates, with said apertures of said pair of plates being aligned so that fastening pins may be inserted therethrough and also through members which connect together said bottom connections of said adjoining truss frames.

16. The truss frame of claim 3 wherein each said rail member comprises a unitary, U-shaped structure which is attached to one of said top rails of said truss frame.

17. The truss frame of claim 8 wherein adjacent top rails are joined together end to end by a corner element which is diagonally disposed at substantially a forty-five degree angle with respect to each of the top rails being joined, and wherein said means for connecting external apparatus to said top rails comprises a pair of parallel, spaced-apart accessory tabs attached to each of said corner elements, said tabs being located on the outer perimeter surface of said corner elements and being disposed so as to be in planes which are substantially perpendicular to the plane of said outer perimeter surface and also perpendicular to the plane which contains said top rails, each of said pair of tabs having openings defined therethrough which are aligned with each other so that external apparatus may be connected to said tabs by means of a fastening pin inserted through said openings.

18. The truss frame of claim 13 wherein said corner braces are further disposed so as to be spaced apart from the location where said adjacent top rails are joined together, and so that said corner braces are attached to each of said top rails at a location intermediate the opposite ends thereof, whereby the unbraced length of each top rail is shortened.

19. A modular scaffolding platform, comprising:

a plurality of truss frames, each of said truss frames including at least three top rails, said rails being joined together so as to define a substantially planar surface, each of said truss frames also including a plurality of bracing members attached to and depending from said top rails, said members being disposed so that all of said members are connected together to form a bottom connection which has a predetermined location with respect to said top rails, with said predetermined location being chosen so that said bracing members form truss-like braces for said top rails;

means for readily detachably connecting together the top rails of adjoining truss frames so that said top rails form a continuous top chord in a direction parallel to that spanned by the connected truss frames, and so that said truss frames can be readily disconnected and reconnected as required, when connected said truss frames exhibiting high torsional rigidity; and means for readily detachably joining together the bottom connections of adjoining truss frames so that a continuous bottom chord is formed in a direction parallel to that spanned by the connected truss frames, each of said bottom connections including means for receiving said joining means such that said joining means may be readily detached from said bottom connection without requiring disconnection of the top rails of adjoining truss frames, said joining means being disposed so that when said bottom connections are joined together, a bottom chord is formed which extends in a direction parallel to that spanned by said connected truss frames.

20. The platform of claim 19 wherein said means for connecting together said bottom connection points is further disposed so as to provide said platform with a built-in camber.

21. The platform of claim 19 further comprising one or more filler panels disposed between and connected to predetermined ones of said truss frames.

22. The platform of claim 21 wherein each said filler panel is connected to the top rails of the respective adjoining truss frames.

23. The platform of claim 19 further comprising decking removably mounted to said top rails so as to form a substantially continuous support surface thereon.

24. The platform of claim 19 further comprising one or more rail members detachably connected to said truss frames so as to form a guardrail located along predetermined ones of said truss frame top rails.

25. The platform of claim 19 further comprising means for detachably attaching external apparatus directly to at least one of said truss frame top rails.

26. The platform of claim 19 wherein said top rails, said bracing members, and said bottom connection of each of said truss frames are further disposed so as to form the shape of an inverted pyramid.

27. The platform of claim 19 wherein said top rails have apertures defined therein which extend substantially in a direction which is perpendicular to said plane which contains said top rails, and wherein said means for connecting together said top rails of adjoining truss frames comprises:

a connecting link extending between said adjoining top rails, said link having a pair of apertures defined therethrough which are located at opposite ends of said link; and two fastening pins for each said link, each pin being disposed through one of said apertures in said connecting link and also through an associated aperture in one of said top rails.

28. The platform of claim 19 wherein a pair of parallel, spaced-apart bottom connection plates are attached to said bottom connection of each of said truss frame, said bottom connection plates being disposed substantially so as to be in planes which are parallel to the plane which contains said top rails, said plates having apertures defined therein which extend substantially in a perpendicular direction to the plane containing said plates, with said apertures of said pair of plates being aligned with each other, and wherein said means for connecting together the bottom connections of said adjoining truss frames comprises:

a connecting member which extends between said adjoining bottom connections, said member having a pair of apertures defined therein which are located at opposite ends of said member; and a pair of fastening pins for each said member, each pin being disposed through one of said apertures in said connecting member and also through said aligned apertures in the associated pair of said connection plates.

29. The platform of claim 24 wherein each of said rail members comprises a unitary, U-shaped structure which is attached to one of said top rails of said truss frames.

30. The platform of claim 25 wherein adjacent top rails of each truss frame are joined together end to end by a corner element which is diagonally disposed at substantially a forty-five degree angle with respect to each of the top rails being joined, and wherein said means for attaching external apparatus to said top rails comprises a pair of parallel, spaced apart accessory tabs attached to each of said corner elements, said tabs being located on the outer perimeter surface of said corner elements and being disposed so as to be in planes which are substantially perpendicular to the plane of said outer perimeter surface and also perpendicular to the plane which contains said top rails, each said pair of tabs having openings defined therethrough which are aligned with each other so that said external apparatus may be connected to said tabs by means of a fastening pin inserted through said openings.

* * * * *